US005271671A

United States Patent [19]

Mandel

[11] Patent Number: 5,271,671

[45] Date of Patent: Dec. 21, 1993

[54] GASKET RETENTION ASSEMBLY

[75] Inventor: Sheldon W. Mandel, Galesburg, Ill.

[73] Assignee: Maytag Corporation, Newton, Iowa

[21] Appl. No.: 842,499

[22] Filed: Feb. 27, 1992

[51] Int. Cl.[5] ..... A47B 96/00; E06B 7/00

[52] U.S. Cl. ..... 312/405; 312/296; 312/406.2

[58] Field of Search ..... 312/405, 405.1, 406, 312/406.1, 406.2, 296; 49/478, 494

[56] References Cited

U.S. PATENT DOCUMENTS

| | | | |
|---|---|---|---|
| 1,749,336 | 3/1927 | Geyer . | |
| 1,862,285 | 9/1930 | Terry et al. . | |
| 1,947,352 | 8/1932 | Macklanburg . | |
| 2,106,322 | 1/1938 | Harnly | 49/494 |
| 2,210,617 | 6/1939 | Calcutt | 49/494 |
| 2,571,600 | 4/1949 | Nave . | |
| 2,724,876 | 11/1955 | Chagnon | 49/494 |
| 2,764,787 | 9/1953 | Lyon . | |
| 2,866,675 | 12/1958 | Kesling | 312/406.2 |
| 3,125,389 | 3/1964 | Swaneck, Jr. | 49/478 |
| 3,331,648 | 7/1967 | Petkwitz et al. | 312/405 |
| 3,572,798 | 10/1968 | Kunevicius . | |
| 4,134,626 | 1/1979 | Kordes | 312/405 |
| 4,203,608 | 5/1980 | Nicholson . | |
| 4,644,698 | 2/1987 | Gerdes et al. | 49/478 |

*Primary Examiner*—Victor N. Sakran
*Attorney, Agent, or Firm*—Bacon & Thomas

[57] ABSTRACT

A gasket retention assembly for uniformally maintaining a gasket against a planar surface. The assembly includes a plate formed from a plurality of wave-shaped sections which define crest portions between adjacent trough portions. The plate is adapted to be secured to the planar surface by means of fasteners at the crest portions with a gasket interposed between the plate and planar surface such that the trough portion are deflected to apply a compressive force against the gasket. The assembly is particularly applicable for use in a refrigerator door arrangement having a gasket fixedly secured between a door panel and a door liner.

13 Claims, 2 Drawing Sheets

GASKET RETENTION ASSEMBLY

BACKGROUND OF THE INVENTION

1. Field of the Invention

The present invention generally involves a gasket retention arrangement for use in securely maintaining a gasket against a planar surface. More particularly, the invention pertains to a refrigerator door liner having an outwardly projecting flange including a plurality of spaced apertures for securing the liner to a refrigerator door panel with a gasket therebetween.

2. Description of the Prior Art

Refrigerator door liners having integrally formed flanges for use in securing the liner to a door panel with a gasket therebetween are known in the art. In such arrangements, the flange is planar and includes a plurality of spaced apertures through which tie-down screws or other fasteners extend for fixedly securing the liner to the door panel, with a gasket being provided between the liner flange and panel. When such a straight, flat flange is used, there is a tendency for the flange, which is generally formed from plastic, to not hold the door gasket in full, intimate contact with the door panel when the screws are tightened. In practice, the gasket tends to be securely maintained between the door liner and panel at and closely adjacent to the tie-down screws but loose therebetween mainly due to bulging or flexing of the liner.

One possible solution to this problem would be to provide additional tie-down screws so that the distance between adjacent screws is reduced. Unfortunately, this solution adds additional cost in the form of the screws themselves and the additional installation time required. One known prior art arrangement provides an elongated metal plate atop the flange through which the tie-down screws extend. Since the metal plate is more rigid than the plastic flange, liner bulging or flexing is minimized and this results in a better seal. Unfortunately, this arrangement also increases cost by requiring an additional structural element to be used, and also requires additional assembly time since the apertures in the metal plate and the flange have to be aligned.

Therefore, there exists a need in the art for a gasket retention arrangement which can securely maintain a gasket in intimate contact against a surface without the need for additional structural components or substantial added costs.

SUMMARY OF THE INVENTION

The present invention pertains to a unique gasket retention assembly for securely maintaining a gasket against a planar surface. The gasket retention assembly includes a plate formed from a plurality of wave-shaped sections which define crest portions between adjacent trough portions. An aperture is formed in each of the crest portions through which a fastener, such as a screw, extends for securing the flange to the planar surface with the gasket therebetween.

The gasket retention assembly of the present invention is particularly adapted for use with a refrigerator door including a door panel to which a door liner is fixedly secured with a gasket therebetween. The liner is integrally formed with an outwardly projecting flange which defines the wave-shaped sections discussed above. When the flange is secured to a rear surface portion of the door panel by means of a plurality of fasteners extending through the apertures in the crest portions of the flange, the trough portions of the flange are deflected and apply a compressive force against the gasket to securely maintain the gasket between the flange of the door liner and the rear surface of the door panel. In this manner, the gasket can be securely maintained in a desired position without the use of additional structural components. Therefore, the gasket retention arrangement of the present invention provides a more aesthetically pleasing uniform appearance while preventing the intermittent flange contact problem associated with the prior art.

Other objects, features and advantages of the invention shall become more apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
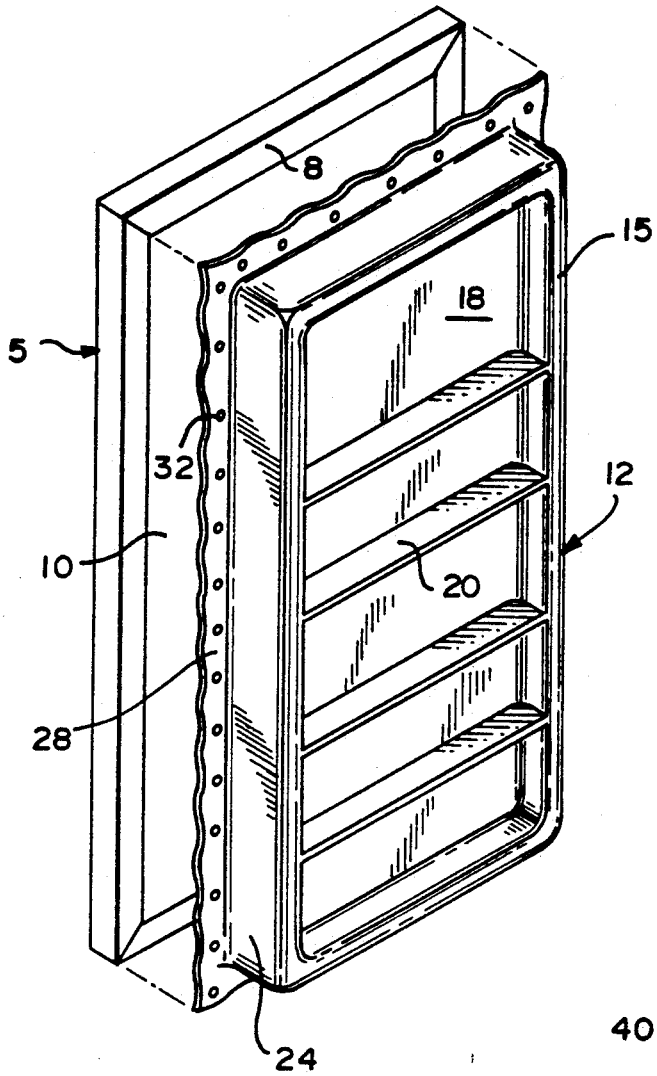
FIG. 1 is an exploded view of a refrigerator door assembly incorporating the present invention.

With initial reference to FIG. 1, a door panel, such as a refrigerator door panel, is generally indicated at 5. In the preferred embodiment door panel 5 is preferably formed from sheet metal that is bent over to form a peripheral rear surface portion 8, as is known in the art. The body 10 of door panel 5 is generally filled with an insulating material such as foam.

A door liner 12 is adapted to be fixedly secured to door panel 5 and in the preferred embodiment, liner 12 is molded as an integral one-piece unit from a plastic material, such as ABS or high impact polystyrene. Door liner 12 includes a main body portion 15 having a recess central cavity 18 provided with a plurality of shelves 20, side walls 24 having a first edge portion 25 (see FIG. 4) integrally formed with main body portion 15 and a second edge portion 26 (also see FIG. 4). An outwardly projecting flange 28 is integrally formed with second edge portion 26 of side walls 24. As clearly shown in FIG. 1, flange 28 is provided with a plurality of apertures 32 provided at spaced intervals along its length. As will be discussed more fully below. Apertures 32 are adapted to receive fasteners for fixedly securing door liner 12 to door panel 5 with a gasket (not shown in FIG. 1) therebetween.

Figure 2:
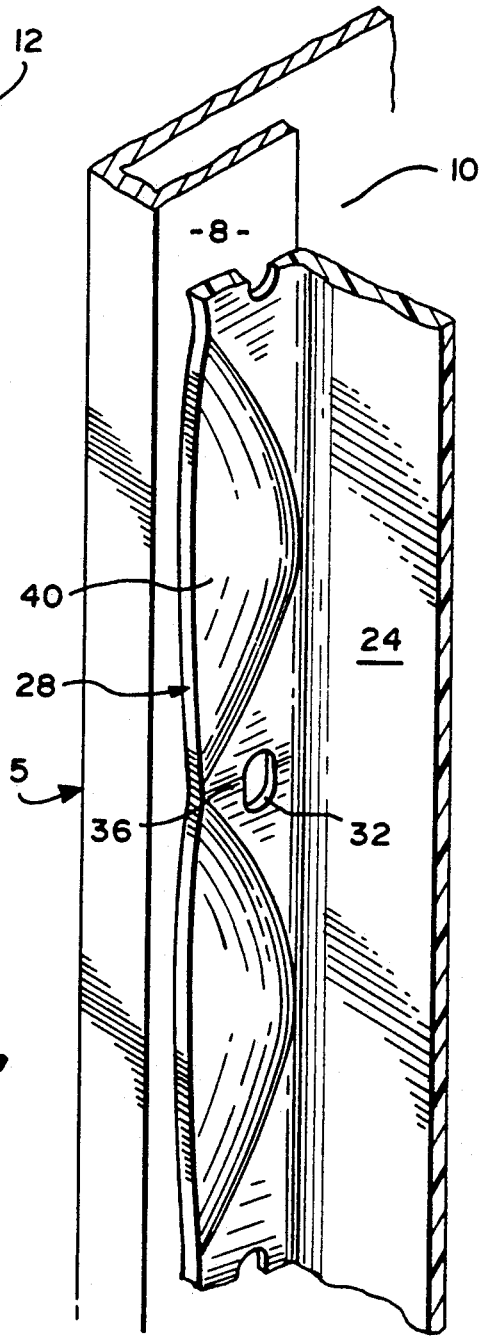
FIG. 2 shows an enlarged section of a portion of the door liner shown in FIG. 1.

Particular reference will now be made to FIGS. 2 and 3 in discussing the specific structure of flange 28. Flange 28 is formed from a plurality of wave-shaped sections including crest portions 36 located between adjacent trough portions 40. Since side wall 24 is planar, trough portions 40 of flange 28 are generally parabolic in form as viewed in FIG. 2. As clearly shown in these figures, apertures 32 comprise oval-shaped slots which are adapted to receive tie-down screws 45. In the preferred embodiment, tie-down screws 45 may comprise conventional self-tapping sheet metal screws for securing flange 28 to rear surface portion 8 of door panel 5.

Figure 4:
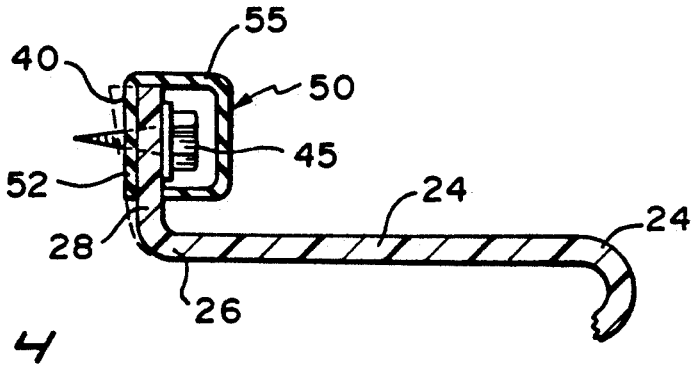
FIG. 4 depicts a partial cross-sectional view of a side of the door liner shown in FIG. 1 with a gasket mounted thereon.

Door liner 12 is adapted to be secured to door panel 5 with a gasket, generally indicated at 50 in FIG. 4, therebetween. As is known in the art, gasket 50 is formed from an elastomeric material, such as a soft vinyl, and includes a base portion 52 adapted to be interposed between rear surface portion 8 of door panel 5 and flange 28 and a wrap-around portion 55 which extends about flange 28 and covers tie-down screws 45. As is known in the art, gasket 50 encloses tie-down screws 45 and is located between rear surface portion 8 of door panel 5 and flange 28 for the entire length of flange 28. In FIG. 4, trough portion 40 is shown in its non-deflected state in phantom without gasket 50 thereabout for illustrative purposes only.

By this construction, when flange 28 is secured to rear surface portion 8 of door panel 5 by means of tie-down screws 45 extending through apertures 32, trough portions 40 will be deflected and compressed against gasket 50 so that flange 28 will become substantially flat and straight. Since gasket 50 is located between flange 28 and rear surface portion 8 of door panel 5, gasket 50 will be securely maintained in a desired position as crest portion 36 due to tie-down screws 45 and between adjacent screw locations by the compressive force exerted on base portion 52 of gasket 50 by trough portions 40. Apertures 32 are formed as slots in order accommodate the minor variation in length of each flange section when trough portions 40 are deflected.

Figure 3:
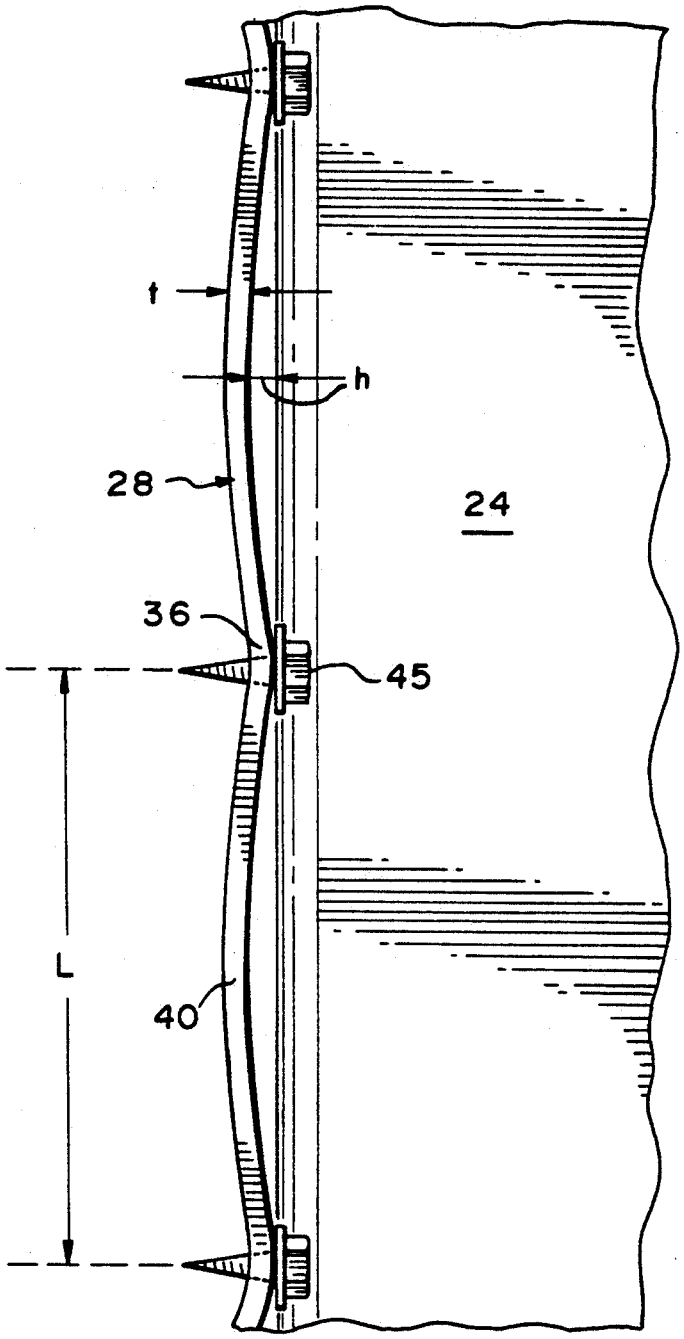
FIG. 3 depicts a side view of a portion of the door liner shown in FIG. 1.

In the preferred embodiment, the thickness (t) of plastic liner 12 and flange 28 is in the range of 80–100 mils and the maximum height (h) of trough portions 40 is in the range of 60–100 mils (see FIG. 3). Based on these specifications, the increase in length of flange 28 due to compression of trough portions 40 into a flat configuration is minimal while still providing the desired compressive force to base portion 52 of gasket 50. Furthermore, in the preferred embodiment, the length (L) along flange 28 between the centers of adjacent apertures 32 is on the order of 3–4 inches. In a specific preferred embodiment, a flange thickness of 90 mils, a trough height of 60 mils and a screw spacing of 3.5 inches is used.

Although described with respect to a particular embodiment of the invention, it is to be understood that various changes and/or modifications can be made to the arrangement disclosed without departing from the spirit or scope of the present invention. In general, it is intended that the invention be limited only by the scope of the following claims.

I claim:

1. A refrigerator door assembly comprising:

a door panel having a rear surface portion;

a door liner having a main body portion including a recessed cavity and side walls which terminate in an integrally formed flange, said flange having a repetitive wave-shaped configuration and a plurality of spaced apertures, said wave-shaped configuration including a plurality of crest portions between a plurality of adjacent trough portions, said plurality of apertures being located in said crest portions; and means for securing said flange to said door panel, said securing means comprising a plurality of fasteners extending through said apertures and into said door panel.

2. A refrigerator door assembly as claimed in claim 1, wherein said plurality of apertures comprise slots.

3. A refrigerator door assembly as claimed in claim 1, further including a gasket located between said flange and said door panel such that when said fasteners are tightened into said door panel, said trough portions are deflected and apply a compressive force against said gasket.

4. A refrigerator door assembly as claimed in claim 3, wherein said gasket extends around said flange and encloses said fasteners.

5. A refrigerator door assembly as claimed in claim 1, wherein each of said trough portions have a generally parabolic configuration.

6. A door liner adapted to be secured to a door panel with a gasket therebetween, said door liner comprising:

a main body portion;

side walls having a first edge portion integrally formed with said main body portion and a second edge portion;

a flange projecting outwardly from and integrally formed with said second edge portion of said side walls, said flange having a repetitive wave-shaped configuration defined by crest portions between adjacent trough portions, said flange being adapted to be fixedly secured to a door panel at the crest portions to compress the trough portions against a gasket interposed therebetween.

7. A door liner as claimed in claim 6, wherein said flange includes at least one aperture in each of said crest portions for fixedly securing the liner to a door panel.

8. A door liner as claimed in claim 7, wherein said apertures comprise slots.

9. A door liner as claimed in claim 8, wherein each of said trough portions have a generally parabolic configuration.

10. A gasket retention assembly for securely maintaining a gasket against a surface comprising: a plate formed from a plurality of consecutive, longitudinally extending wave-shaped sections which define crest portions between adjacent, longitudinally spaced trough portions, said plate being adapted to be secured to a surface at said crest portions with a gasket interposed therebetween such that said trough portions are deflected to apply a compressive force against the gasket.

11. A gasket retention assembly as claimed in claim 10, wherein said plate includes at least one aperture located in each of said crest portions for securing said plate to the surface.

12. A gasket retention assembly as claimed in claim 11, wherein said apertures comprise slots.

13. A gasket retention assembly as claimed in claim 10, wherein each of said trough portions have a generally parabolic configuration.

* * * * *